US007500786B2

(12) United States Patent
Richardson, Jr. et al.

(10) Patent No.: US 7,500,786 B2
(45) **Date of Patent: *Mar. 10, 2009**

(54) BULK BAG FOR MEAT AND MEAT PRODUCTS

(75) Inventors: Joe Ronald Richardson, Jr., Sadler, TX (US); Bradley Matthew Eisenbarth, Sherman, TX (US); Bobby Glenn Brown, Dennison, TX (US)

(73) Assignee: B.A.G. Corp., Dallas, TX (US)

( * ) Notice: Subject to any disclaimer, the term of this patent is extended or adjusted under 35 U.S.C. 154(b) by 110 days.

This patent is subject to a terminal disclaimer.

(21) Appl. No.: 11/557,149

(22) Filed: Nov. 7, 2006

(65) Prior Publication Data

US 2007/0086681 A1 Apr. 19, 2007

Related U.S. Application Data

(63) Continuation of application No. 11/048,517, filed on Feb. 1, 2005, now Pat. No. 7,156,555, which is a continuation of application No. 10/770,188, filed on Feb. 2, 2004, now Pat. No. 7,018,098, which is a continuation of application No. 10/253,086, filed on Sep. 24, 2002, now Pat. No. 6,739,753.

(60) Provisional application No. 60/389,865, filed on Jun. 20, 2002.

(51) Int. Cl.

| | |
|---|---|
| ***B65D 33/06*** | (2006.01) |
| ***B65D 33/14*** | (2006.01) |
| ***B65D 30/22*** | (2006.01) |
| ***B65D 30/08*** | (2006.01) |
| ***B65D 33/02*** | (2006.01) |
| ***B65D 25/14*** | (2006.01) |

(52) U.S. Cl. ..... 383/16; 383/24; 383/38; 383/113; 383/119; 220/495.08

(58) Field of Classification Search ..... 383/16, 383/24, 38, 105, 113, 119, 124, 33, 67, 107; 220/495.05, 495.08, 495.03

See application file for complete search history.

(56) References Cited

U.S. PATENT DOCUMENTS

| | | | | | |
|---|---|---|---|---|---|
| 4,493,109 | A | * | 1/1985 | Nattrass | 383/7 |
| 4,610,028 | A | * | 9/1986 | Nattrass | 383/7 |
| 4,658,432 | A | * | 4/1987 | Lehmann et al. | 383/20 |
| 4,703,517 | A | * | 10/1987 | Marino | 383/7 |
| 4,730,942 | A | * | 3/1988 | Fulcher | 383/7 |
| 4,901,855 | A | | 2/1990 | Boots | 220/402 |
| 5,025,925 | A | | 6/1991 | Wiklund | 206/386 |
| 5,052,579 | A | * | 10/1991 | Boots | 220/668 |
| 5,104,236 | A | * | 4/1992 | LaFleur | 383/17 |
| 5,289,937 | A | | 3/1994 | Boots | 220/9.1 |
| 5,323,922 | A | | 6/1994 | Lapoint et al. | 220/4.28 |
| 5,605,232 | A | * | 2/1997 | Bickle | 206/764 |
| 5,607,237 | A | * | 3/1997 | LaFleur | 383/22 |
| 6,000,549 | A | * | 12/1999 | Perkins | 206/596 |
| 6,164,453 | A | * | 12/2000 | Perkins | 206/596 |

(Continued)

*Primary Examiner*—Jes F Pascua
(74) *Attorney, Agent, or Firm*—Michael A. O'Neil

(57) ABSTRACT

A bulk bag comprising a bottom wall and at least one side wall extending upwardly from the bottom wall is provided with at least one pocket secured to the exterior of the side wall and extending substantially vertically. The pocket receives a support member which maintains the side wall of the bulk bag in an upright, open configuration.

2 Claims, 13 Drawing Sheets

U.S. PATENT DOCUMENTS 6,220,755 B1 * 4/2001 Brown et al. ..... 383/119
6,224,260 B1 * 5/2001 Nickell et al. ..... 383/119
6,244,443 B1 * 6/2001 Nickell et al. ..... 206/600
6,328,470 B2 * 12/2001 Brown et al. ..... 383/119
6,331,077 B1 * 12/2001 Nickell ..... 383/119
6,402,378 B1 * 6/2002 Shackleton ..... 383/119
6,415,927 B1 * 7/2002 Stone et al. ..... 206/600
6,565,256 B2 * 5/2003 Derby et al. ..... 383/119
6,739,753 B2 * 5/2004 Richardson et al. ..... 383/16
6,921,201 B2 * 7/2005 Richardson et al. ..... 383/16
7,018,098 B2 * 3/2006 Richardson et al. ..... 383/16
7,086,781 B2 * 8/2006 Richardson et al. ..... 383/38
7,156,555 B2 * 1/2007 Richardson et al. ..... 383/16
7,195,397 B2 * 3/2007 Williamson et al. ..... 383/33
2001/0000712 A1 * 5/2001 Nickell et al. ..... 383/119
2001/0004058 A1 * 6/2001 Nickell et al. ..... 206/600
2001/0041023 A1 * 11/2001 Brown et al. ..... 383/119
2002/0008517 A1 * 1/2002 Derby et al. ..... 324/318
2002/0170844 A1 * 11/2002 Stone et al. ..... 206/600
2003/0235349 A1 * 12/2003 Ricahrdson et al. ..... 383/16
2003/0235350 A1 * 12/2003 Richardson et al. ..... 383/24
2004/0040883 A1 * 3/2004 Stone et al. ..... 206/600
2004/0081374 A1 * 4/2004 Richardson et al. ..... 383/38
2004/0151404 A1 * 8/2004 Richardson et al. ..... 383/16
2004/0184679 A1 * 9/2004 Williamson et al. ..... 383/38
2004/0264814 A1 * 12/2004 Eisenbarth et al. ..... 383/32
2005/0063623 A1 * 3/2005 Eisenbarth et al. ..... 383/119
2006/0110074 A1 * 5/2006 Richardson et al. ..... 383/24

* cited by examiner

BULK BAG FOR MEAT AND MEAT PRODUCTS

CROSS-REFERENCE TO RELATED APPLICATIONS

This application is a continuation application of application Ser. No. 11/048,517 filed Feb. 1, 2005, now U.S. Pat. No. 7,156,555, the entire contents of which are incorporated herein by reference; which is a continuation application of application Ser. No. 10/770,188 filed Feb. 2, 2004, now U.S. Pat. No. 7,018,098, the entire contents of which are incorporated herein by reference; which is a continuation application of application Ser. No. 10/253,086 filed Sep. 24, 2002, now U.S. Pat. No. 6,739,753, the entire contents of which are incorporated herein by reference; which claims priority of provisional application Ser. No. 60/389,865 filed Jun. 20, 2002, the entire contents of which are incorporated herein by reference.

TECHNICAL FIELD

This invention relates generally to bulk bags, and more particularly to a bulk bag construction that is particularly adapted for use in conjunction with meat and meat products.

BACKGROUND AND SUMMARY OF THE INVENTION

Heretofore meat and meat products have been transported in large cardboard boxes which are mounted on wooden pallets. As is well known, both cardboard and wood can and do harbor microorganisms, insects, etc. The presence of such organisms in and around containers utilized to receive, store, transport, and discharge meat and meat products can lead to contamination thereof. Total freedom from contamination is an absolute necessity in the food industry. Therefore, a need exists for a container adapted to receive, store, transport and discharge meat and meat products which is incapable of harboring contaminating organisms.

The present invention comprises a bulk bag for meat and meat products which fulfills the foregoing and other requirements that have long since been found lacking in the prior art. In accordance with the broader aspects of the invention, a bulk bag is formed from one or more sheets comprising woven plastic fabric. The woven plastic fabric in turn comprises strips or filaments formed from suitable polymers such as polypropylene, polyethylene, etc. In most instances the sheets of woven plastic material are cut into a plurality of pieces in accordance with a predetermined pattern. The pieces are then joined together by sewing to form the bulk bag.

Bulk bags typically comprise a bottom wall and one or more side walls which are joined to the bottom wall by sewing. In accordance with the present invention the side wall(s) of the bulk bag are provided with one or more vertically extending pockets each having a support member received therein. The function of the support member(s) is to maintain the bulk bag in an upright, open configuration. The bulk bag preferably has the same dimensions as the prior art cardboard box and pallet meat and meat product containers thereby facilitating the use of the bulk bag with conventional tip over discharge equipment.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1:
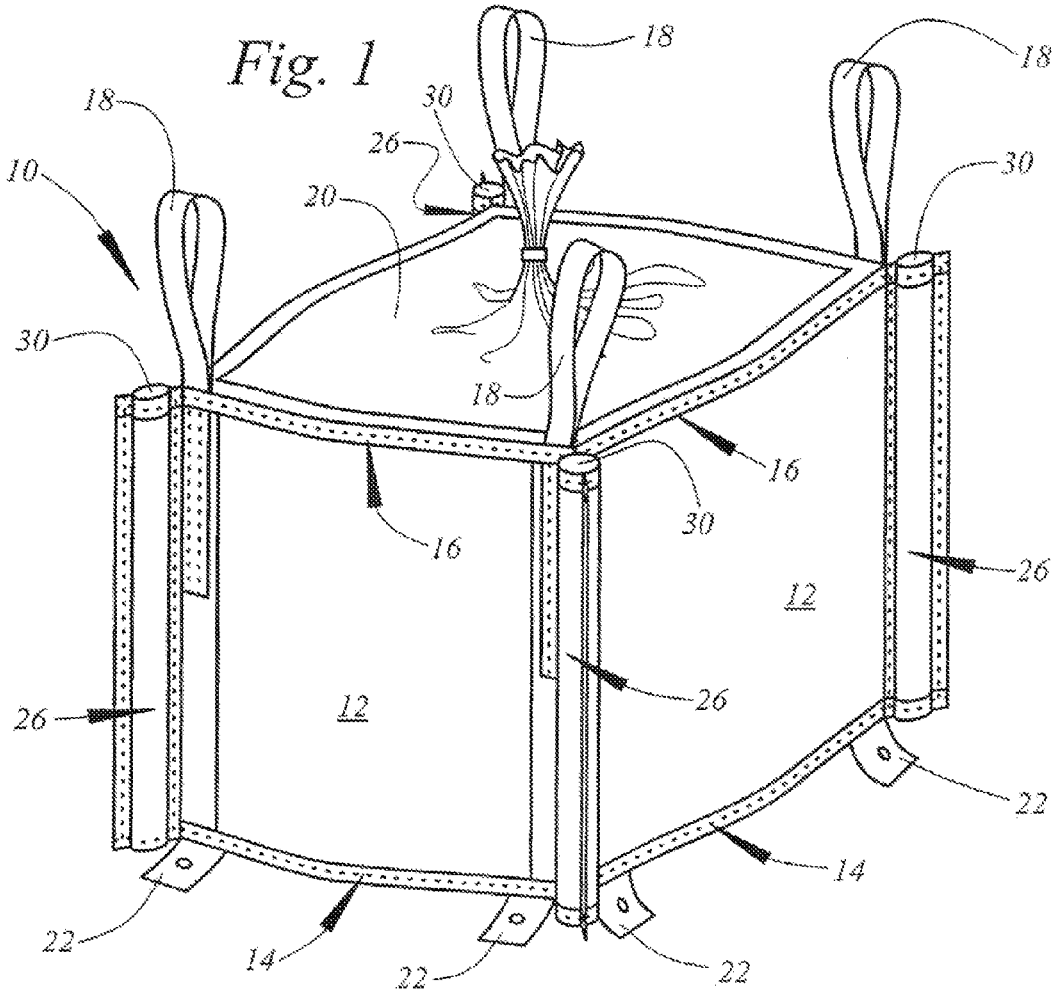
FIG. 1 is a perspective view of a bulk bag for meat and meat products constructed in accordance with a first embodiment of the present invention.

Referring now to the Drawings, and particularly to FIG. 1 thereof, there is shown a bulk bag 10 comprising a first embodiment of the present invention. The bulk bag 10 includes four side walls 12 which may comprise one, two, three, or four side wall panels depending upon the requirements of particular applications of the invention. The bulk bag 10 further comprises a bottom wall which is secured to the lower ends of the side walls 12 by sewing along sew lines 14. The upper ends of the side walls 12 may be reinforced as indicated at 16, however, reinforcement of the upper ends of the side wall is not necessary to the practice of the invention.

The bulk bag 10 may be provided with any of the various well known types of lifting apparatus, such as the lift loops 18 illustrated in FIG. 1. The bulk bag 10 may be provided with a liner 20, however, the use of a liner is not necessary to the practice of the invention. The bulk bag 10 is preferably provided with tabs 22 located at the bottom thereof which are utilized to secure the bulk bag 10 to a conventional tip over discharge apparatus.

The bulk bag 10 is provided with a plurality of vertically extending pockets 26. Each of the pockets 26 receives a support member 30 therein. The support members 30 may be either solid or tubular, for example, the support members 30 may comprise PVC pipe which is readily available and inexpensive. The support members 30 function to retain the side walls 12 of the bulk bag 10 in an upright, open configuration.

As will be appreciated by those skilled in the art, bulk bags are often square or rectangular in cross-sectional configuration, thereby defining four corners. In such instances it is convenient to attach the pockets 26 at the corners of the bulk bag, however, attaching the pockets at the corners is not required in the practice of the invention. Rather, the pockets 26 may be attached at any convenient location.

Bulk bags having a single tubular side wall are also widely used. In the case of a tubular bulk bag, the pockets 26 may be attached to the side wall thereof at any convenient location around the periphery of the bulk bag. The number of pockets used in conjunction with a particular tubular bulk bag depends upon the requirements of particular applications of the invention, it being understood that larger diameter tubular bulk bags will typically require a larger number of pockets 26.

Figure 2:
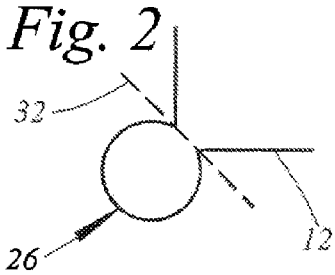
FIG. 2 is an illustration of a first construction technique for the bulk bag of FIG. 1.
Figure 3:
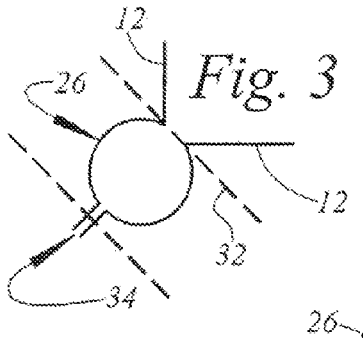
FIG. 3 is an illustration of a second construction technique for the bulk bag of FIG. 1.

FIGS. 2 through 5, inclusive, illustrate various techniques for constructing the pockets 26 of the present invention. Referring particularly to FIG. 2, when the pocket 26 is formed at a location on the side walls 12 of the bulk bag that does not include a seam, the fabric of the side walls may extend to form a loop which is then closed by sewing as indicated by the sew line 32. Referring to FIG. 3, if the location of the pocket 26 is coincident with a seam 34 an additional sew line 36 is utilized to close the seam.

Figure 4:
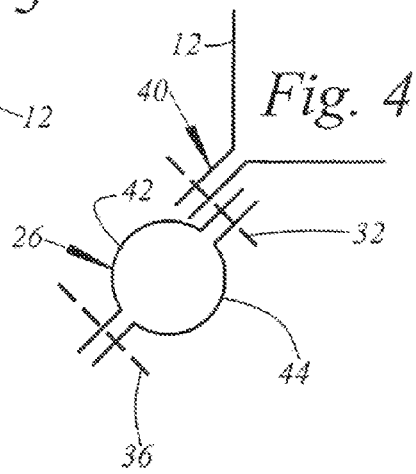
FIG. 4 is an illustration of a third construction technique for the bulk bag of FIG. 1.
Figure 5:
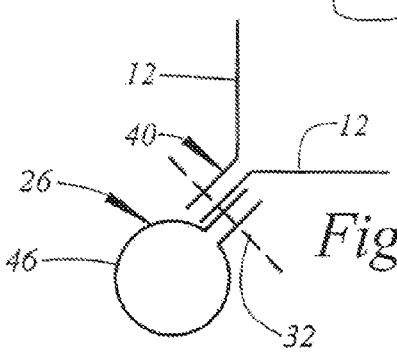
FIG. 5 is an illustration of a fourth construction technique for the bulk bag of FIG. 1.

FIGS. 4 and 5 illustrate embodiments of the invention wherein the pocket 26 is constructed independently of the fabric of the side walls of the bulk bag. Referring particularly to FIG. 4, the side walls 12 are joined at one of the corners of the bulk bag by a seam 40. A pocket 26 comprises panels 42 and 44. The sew line 32 performs the triple function of closing the seam 40, joining the panels 42 and 44 along adjacent edges thereof, and securing the pocket 26 to the bulk bag. The seam 34 joins the panels 42 along the opposite edges thereof thereby completing the construction of the pocket 26. FIG. 5 illustrates a similar construction wherein the pocket 26 is formed from a single panel 46. Here again, the sew line 32 performs the triple function of closing the seam 40, joining the adjacent edges of the panel 46 to complete the construction of the pocket 26, and securing the pocket 26 to the bulk bag.

Bulk bags incorporating the present invention may be formed using U panel, tubular, or four panel construction. The corner pockets are dimensional to receive rods or tubes having diameters between about ½" and about 2". The pockets may be formed as part of the side panels of the bag, or attached to the side seams. The pockets are made of bulk bag fabric, narrow fabric webbing, or in lieu of pockets, straps are used in multiple locations in the side seams.

Various lift loop styles may be used including standard four corner vertical loops, spread straps, over-the-corner straps, basket straps and sleeves. The bulk bag will also have tabs, straps, or loops attached to various points at the bottom of the bags to be used to secure the bottom of the bag to the tip over discharge equipment.

The opening of each pocket may have a closure device or the pocket can be left open. Various liner construction can be used with standard attachment options or the bulk bag can be used without a liner.

Figure 6:
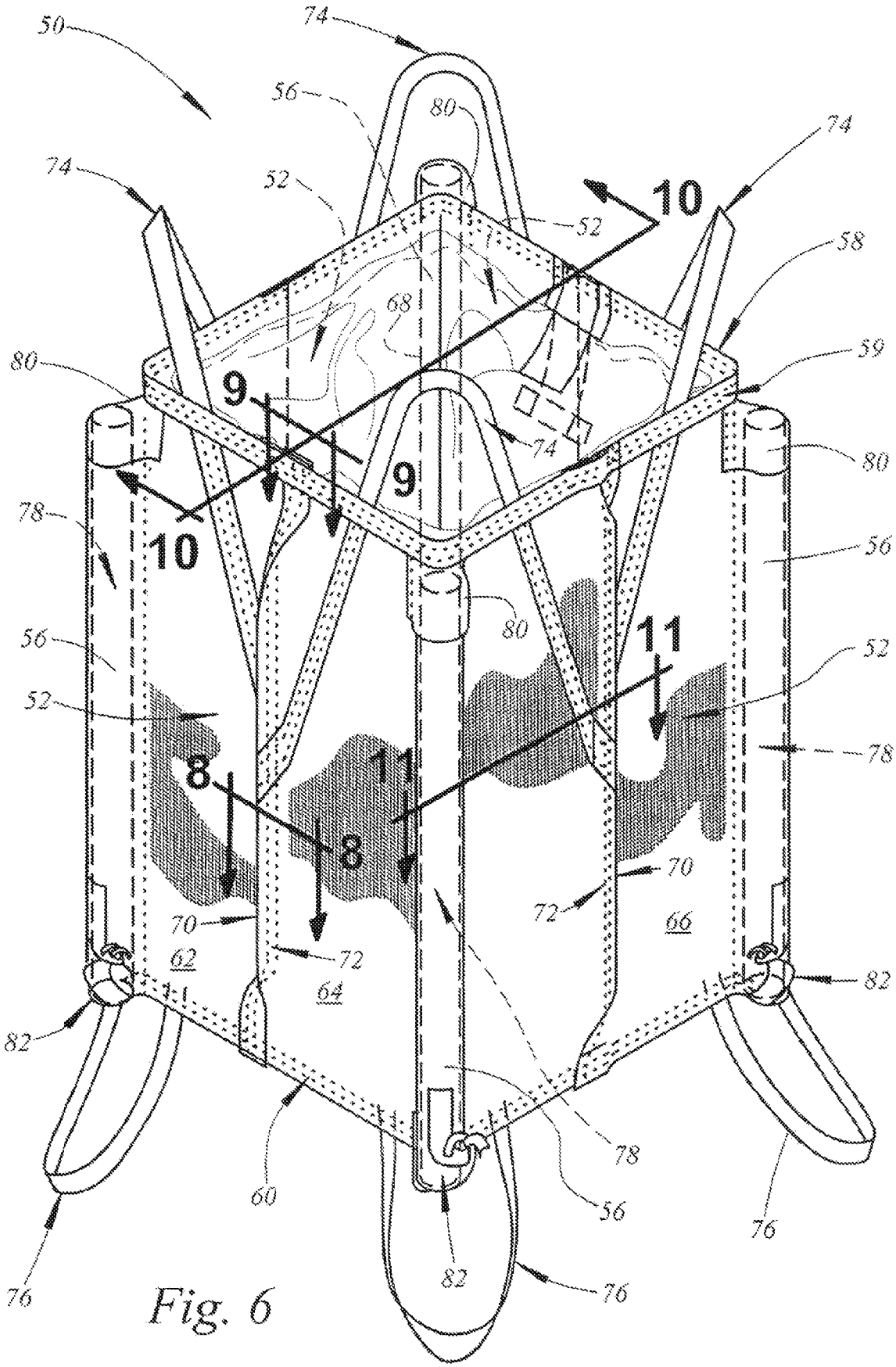
FIG. 6 is a perspective view illustrating a bulk bag for meat and meat products comprising a second embodiment of the invention.
Figure 7:
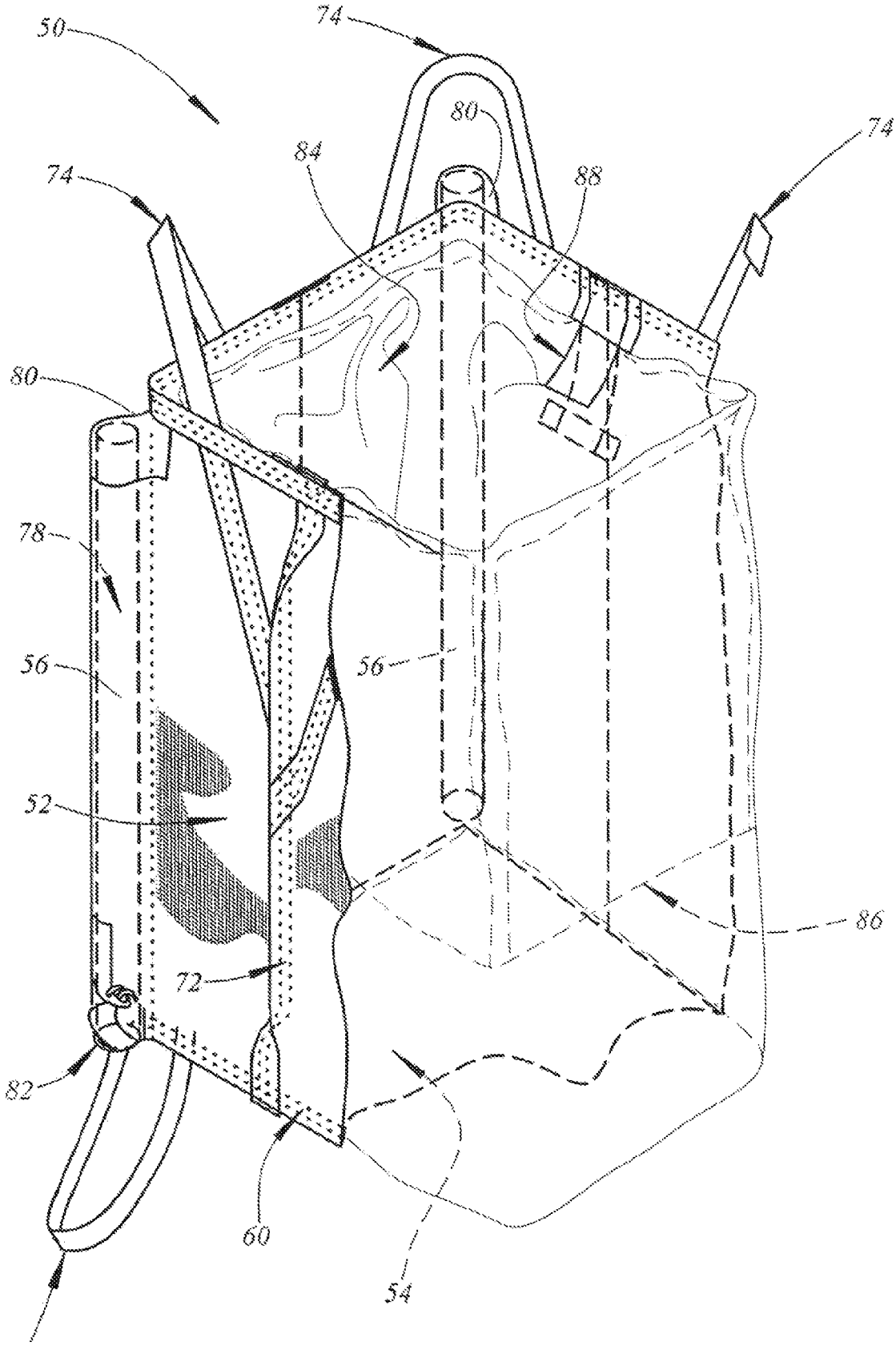
FIG. 7 is a view similar to FIG. 6 in which certain component parts have been broken away more clearly to illustrate certain features of the invention.
Figure 8:
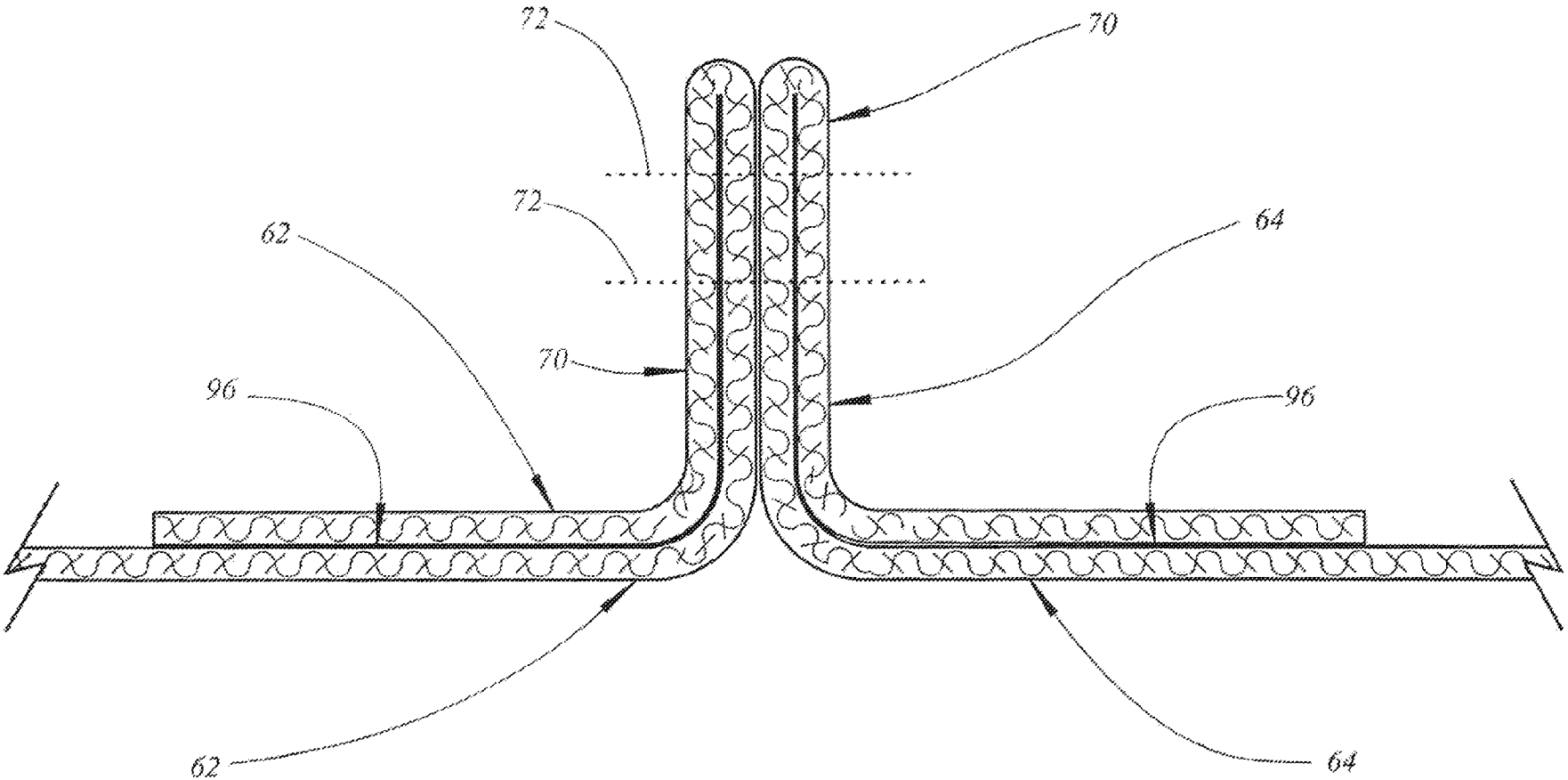
FIG. 8 is a sectional view taken along the line 8-8 in FIG. 1 in the direction of the arrows.
Figure 9:
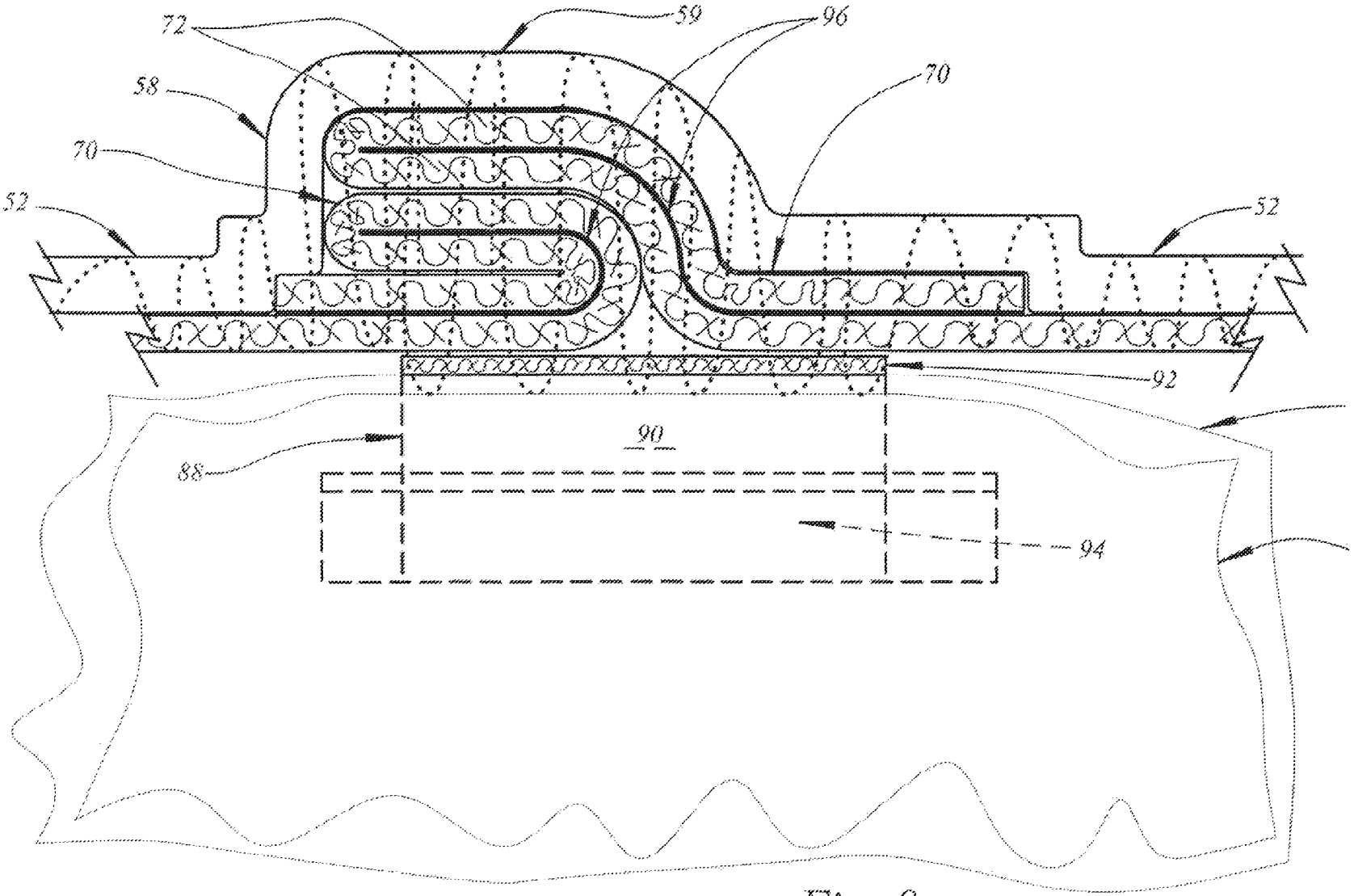
FIG. 9 is a diagrammatic illustration of the upper portion of the bulk bag shown in FIG. 6 taken along the line 9-9 in FIG. 6 in the direction of the arrows.

Referring now to FIGS. 6 through 10, inclusive, and particularly to FIG. 6 there is shown a bulk bag 50 comprising a second embodiment of the invention. The bulk bag 50 comprises four side walls 52 and a bottom wall 54 (FIGS. 7 and 9). The side walls 52 and the bottom wall 54 define a rectangular enclosure. The side walls 52 intersect at corners which define vertically disposed pockets 56 located outside of the rectangular enclosure. A reinforcing band 58 is provided along the tops of the side walls 52, and is secured by seams 59. The bottoms of the side walls 52 are joined to the bottom wall 54 by seams 61.

Figure 11:
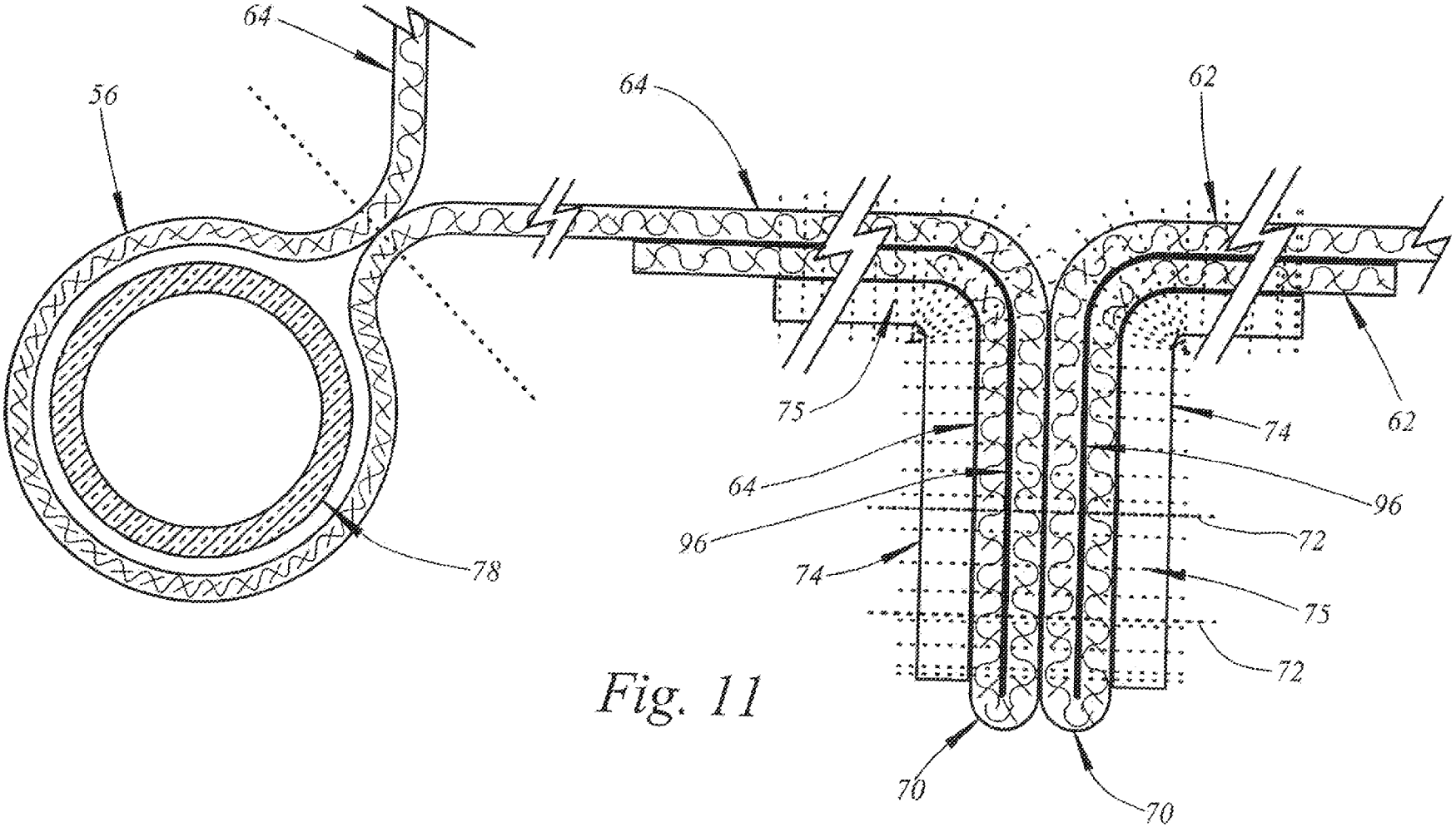
FIG. 11 is a sectional view taken along the line 11-11 in FIG. 1 in the direction of the arrows.
Figure 12:
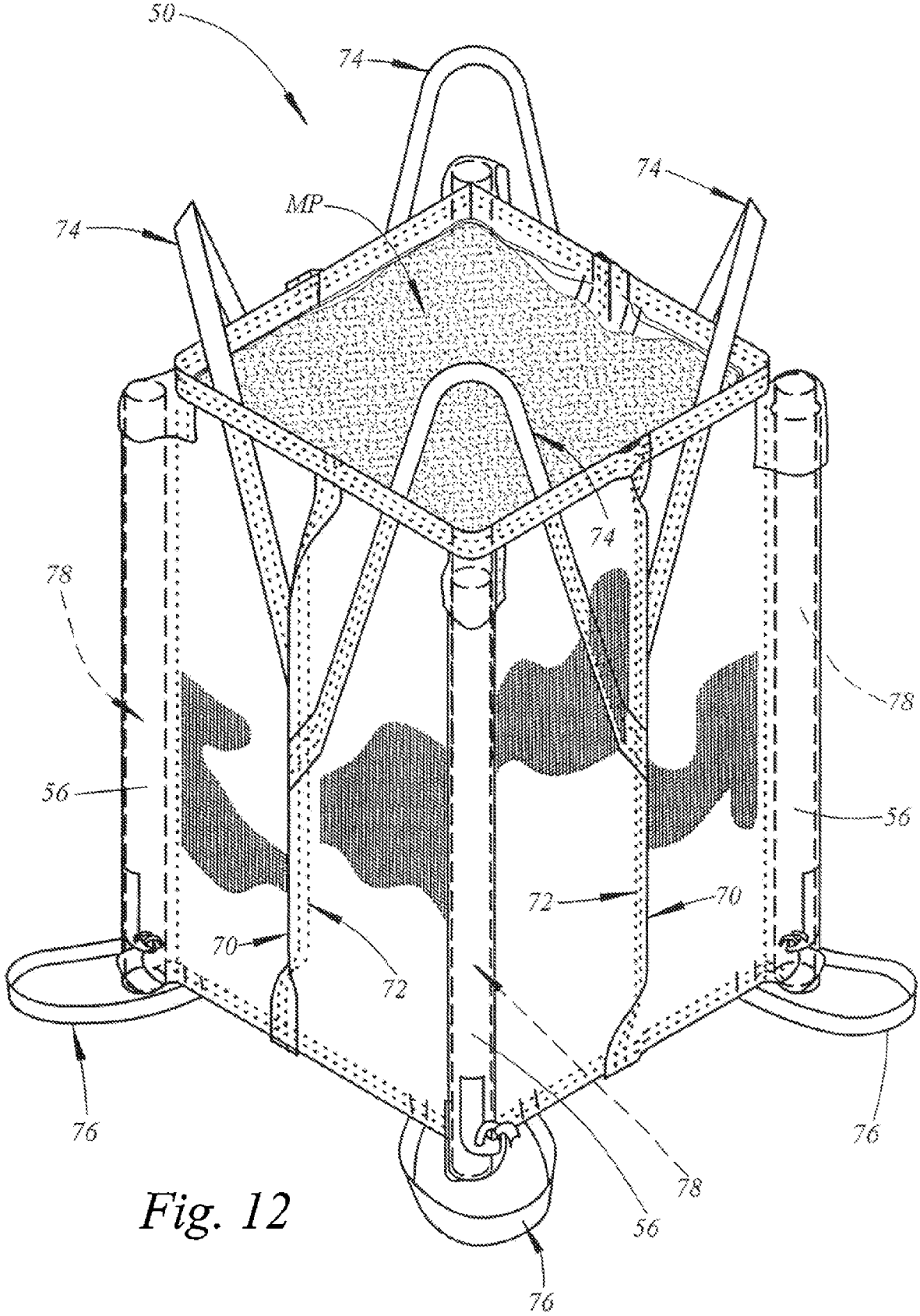
FIG. 12 is a view similar to FIG. 6 showing the bulk bag thereof in its filled configuration.

The bulk bag 50 is constructed from four corner panels 62, 64, 66, and 68. As is best shown in FIG. 8, the opposite vertically extending edges of each of the corner panels are folded over and adhesively secured to provide reinforced edges 70. Referring again to FIG. 6, the reinforced edges of the corner panels are joined by side seams 72 to define the bulk bag 50. The bulk bag 50 is provided with lift loops 74 which are secured to the fabric of the corner panels by sewing along seams 75. As is shown in FIG. 11, the lift loops 74 are secured to their respective corner panels by the side seam 72 and by the seams 59 which secure the reinforcing band 58. The lift loops 74 are secured to the side walls 52 by seams 75. In this manner the lift loop 74 is secured in an upright configuration to facilitate manipulation of the bulk bag 50 by forklift trucks and similar apparatus.

Securing loops 76 are provided at the bottom of each corner of the bulk bag 50. The securing loops 76 are secured to the bulk bag 50 during construction thereof and function to secure the bulk bag 50 to a conventional tip over apparatus (not shown) to facilitate discharge of the contents of the bulk bag 50.

Referring to FIG. 11, the pockets 56 are constructed from the fabric of the corner panels comprising the bulk bag 50 and a seam 77 in a manner similar to that shown in FIG. 2 and described hereinabove in conjunction therewith. Each corner pocket 56 is located outside of the rectangular enclosure defined by the side walls 52 and receives a structural member 78 which preferably comprises a length of PVC pipe. The function of the structural member 78 is to maintain the bulk bag 50 in an upright and open configuration to facilitate filling thereof.

The upper end of each pocket 56 is provided with a sewn-in-place shield 80 which prevents contamination of the interior of the pocket 56 during filling of the bulk bag 50. The lower end of each pocket 56 is provided with a releasable closure 82 which secures the structural members 78 within the pocket 56 during filling, transport, and discharge of the bulk bag 50, while facilitating removal of the structural members 78 after the bulk bag 50 has been emptied. The releasable closures 82 preferably comprise tie down straps, however, other releasable closure configurations will readily suggest themselves to those skilled in the art.

Figure 10:
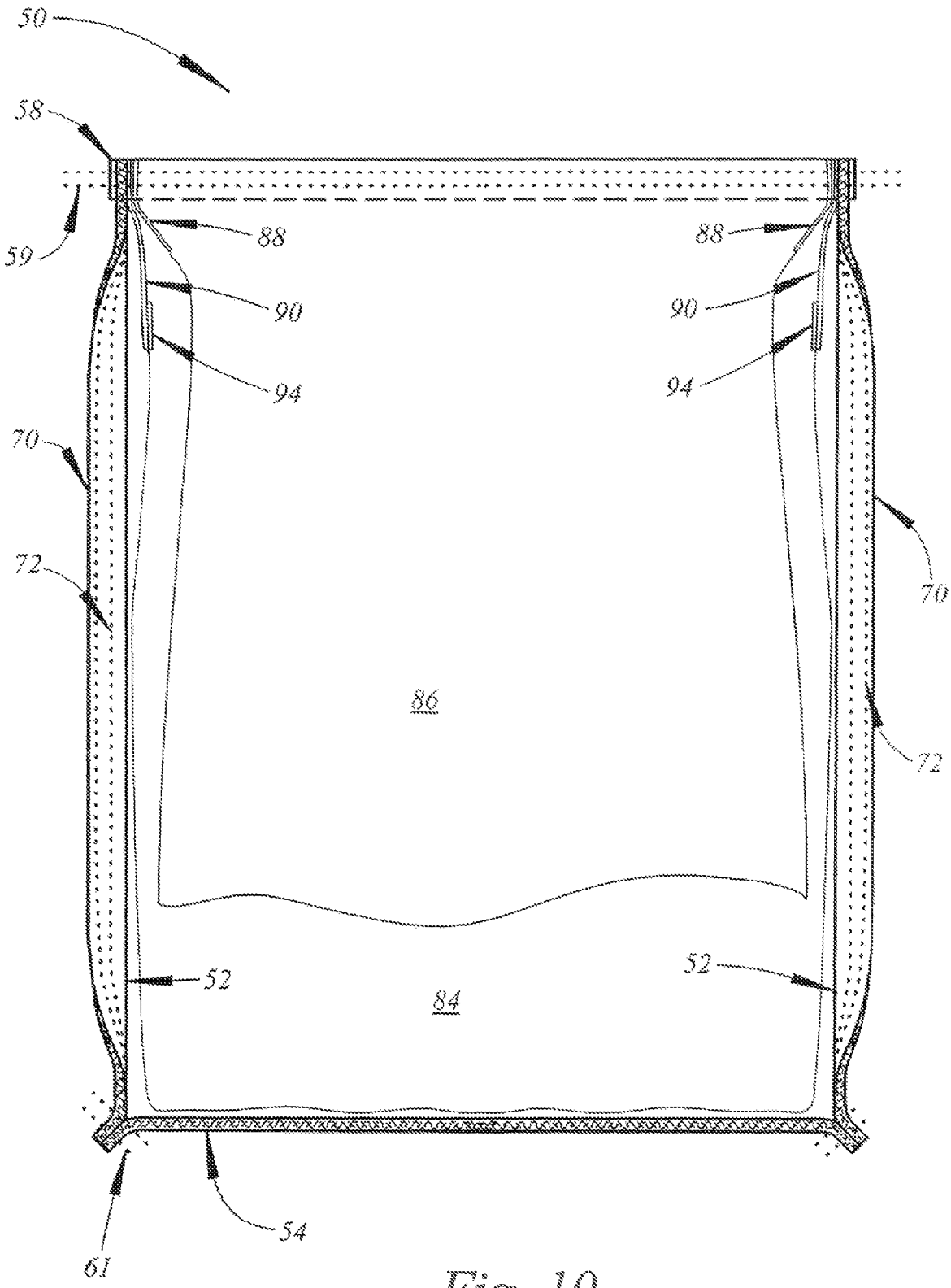
FIG. 10 is a sectional view taken along the line 10-10 in FIG. 1 in the direction of the arrows.

As is best shown in FIGS. 7 and 10, the bulk bag 50 further includes a liner 84. The main portion of the liner 84 extends across the bottom wall 54 of the bulk bag 50 and then upwardly along the side walls 52 thereof. At the upper ends of the side walls 52 the liner 84 is folded inwardly and then extended downwardly to define a skirt 86. An important feature of the bulk bag 50 comprises the fact that the liner 84 is secured to the upper ends of the side walls 52 by tabs 88.

Referring to FIG. 9 each tab 88 comprises a layer of plastic tape 90 of the type comprising longitudinally extending lengths of reinforcing fibers. Each tab 88 includes a sectional of woven polypropylene fabric 92 at the upper end thereof which is secured to the tape 90 by a suitable adhesive and which is sewn into the reinforcing band 58. The liner 84 and the skirt 86 thereof are secured to the tab 88 by means of a suitable adhesive. The tab 88 may be provided with an additional length of woven polypropylene fabric 94 which further secures the tab 88 against tearing.

Referring to FIG. 8, the reinforced edges 70 of the corner panels 62, 64, 66, and 68 comprise doubled-over edge portions of the fabric comprising the corner panels which are secured in place by adhesive layers 96. Referring again to FIG. 9, the upper portions of the reinforced edges 70 are doubled over and are secured in place by the seams 59 which also function to secure the reinforcing band 58 in place. The seams 59 also secure the tabs 88 to the side walls 52 of the bulk bag. Referring to FIG. 11, the lift loops are secured to the reinforced edges of the corner panels 62, 64, 66, and 68 by the seams 75.

Utilization of the bulk bag 50 is illustrated in FIGS. 12 through 16, inclusive. The bulk bag 50 is typically filled with a quantity of meat products MP. The securing loops 76 are utilized to secure the bulk bag 50 to a conventional tip over apparatus (not shown) of the type utilized in conjunction with prior art meat product transporting devices. After the securing loops 76 are secured to the tip over apparatus, the tip over apparatus is utilized to invert the bulk bag 50 so that the meat product MP can be discharged therefrom.

Figure 13:
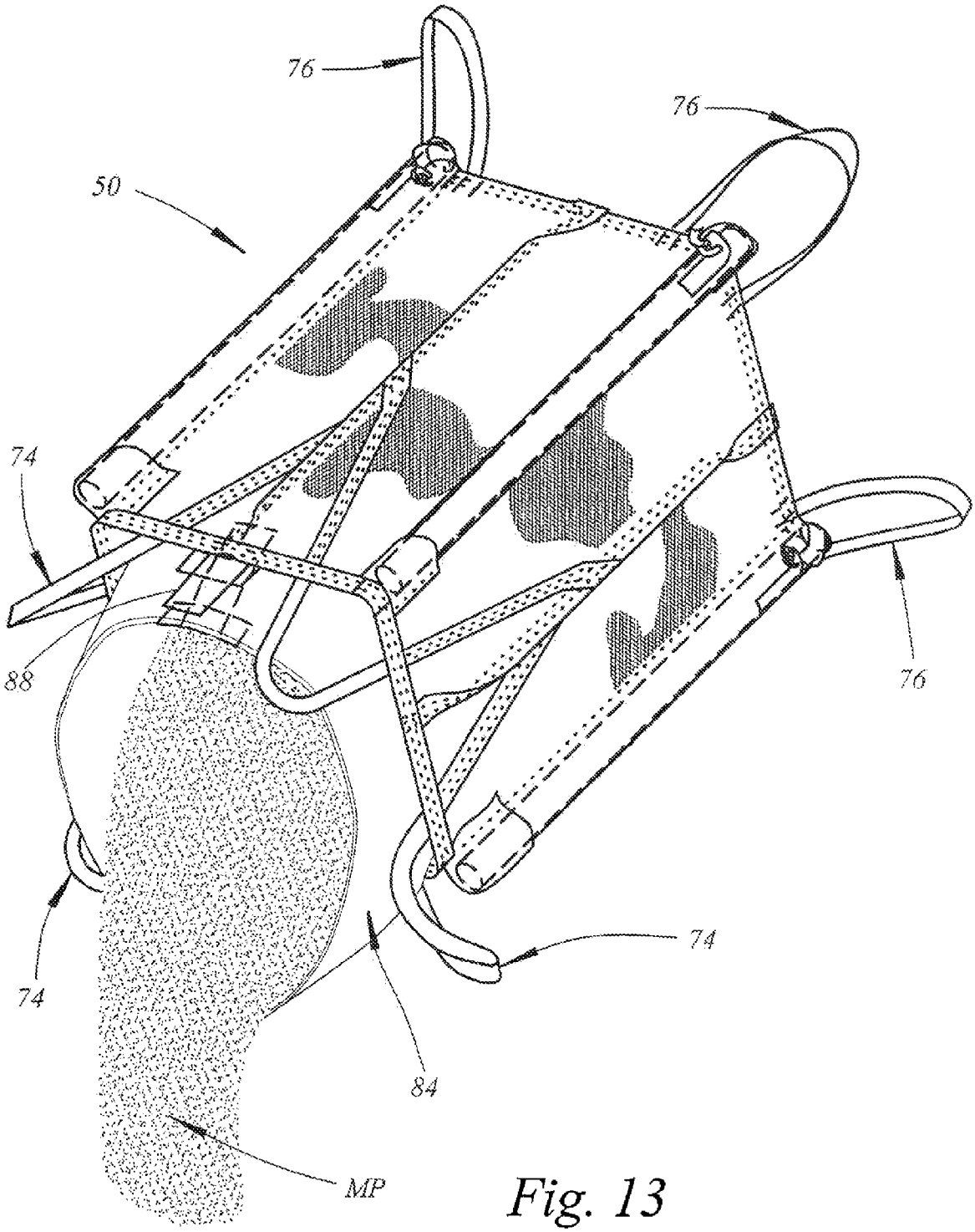
FIG. 13 is an illustration of a bulk bag of FIG. 12 showing an early step in the discharge of product therefrom.

FIG. 13 illustrates an early step in the discharge of the meat product MP from the bulk bag 50. The bulk bag 50 is shown partially inverted with the meat product MP beginning to pour outwardly from the liner 84 of the bulk bag 50. Because of the sticky nature of the meat product MP, discharge thereof tends to pull the liner 84 out of the bulk bag 50. However, outward movement of the liner 84 relative to the bulk bag 50 is restrained by the tabs 88 which secure the liner 84 to the upper end of the bulk bag 50.

Figure 14:
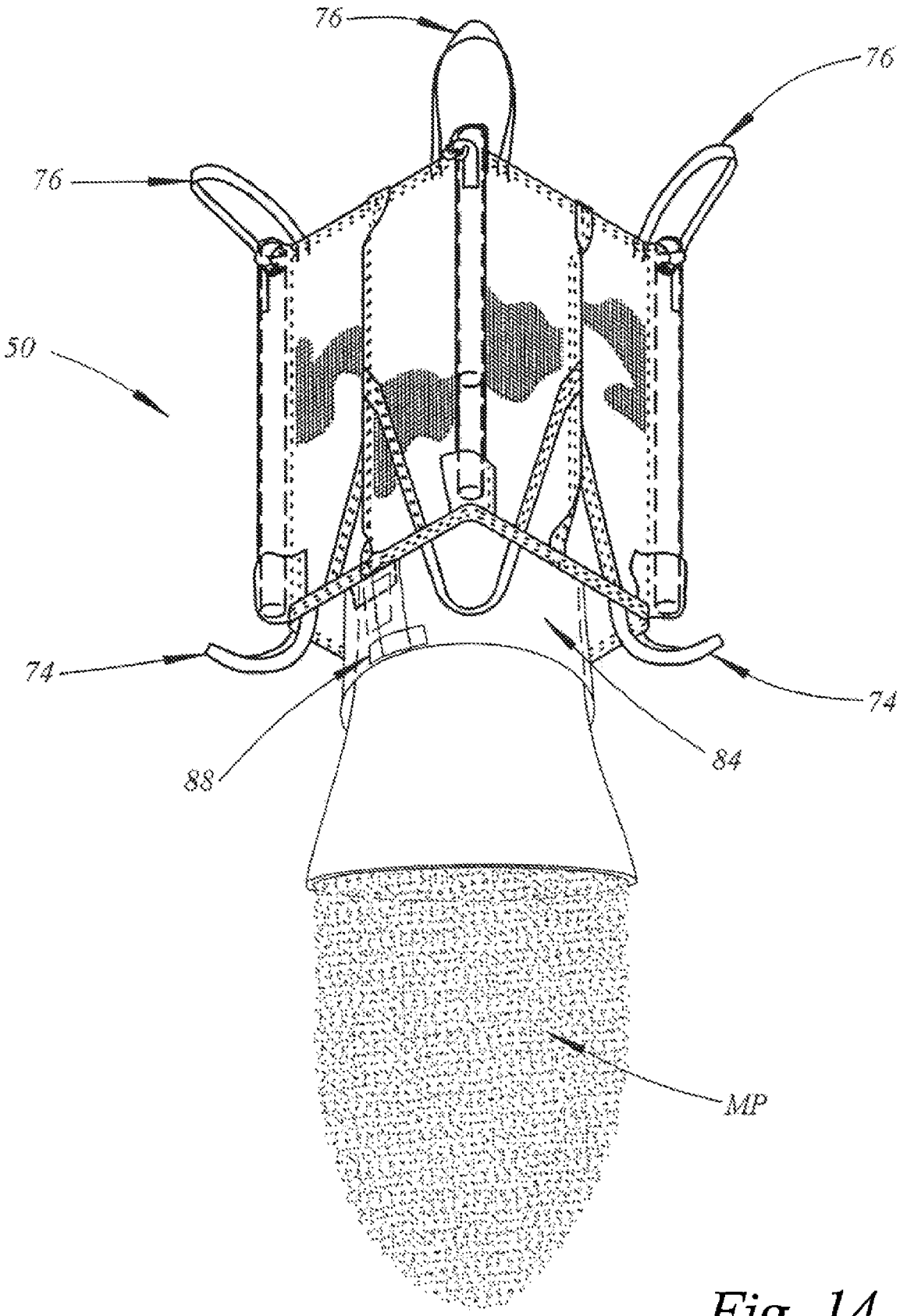
FIG. 14 is an illustration of the bulk bag of FIG. 12 showing the bulk bag at a later stage in the discharge of product therefrom.
Figure 15:
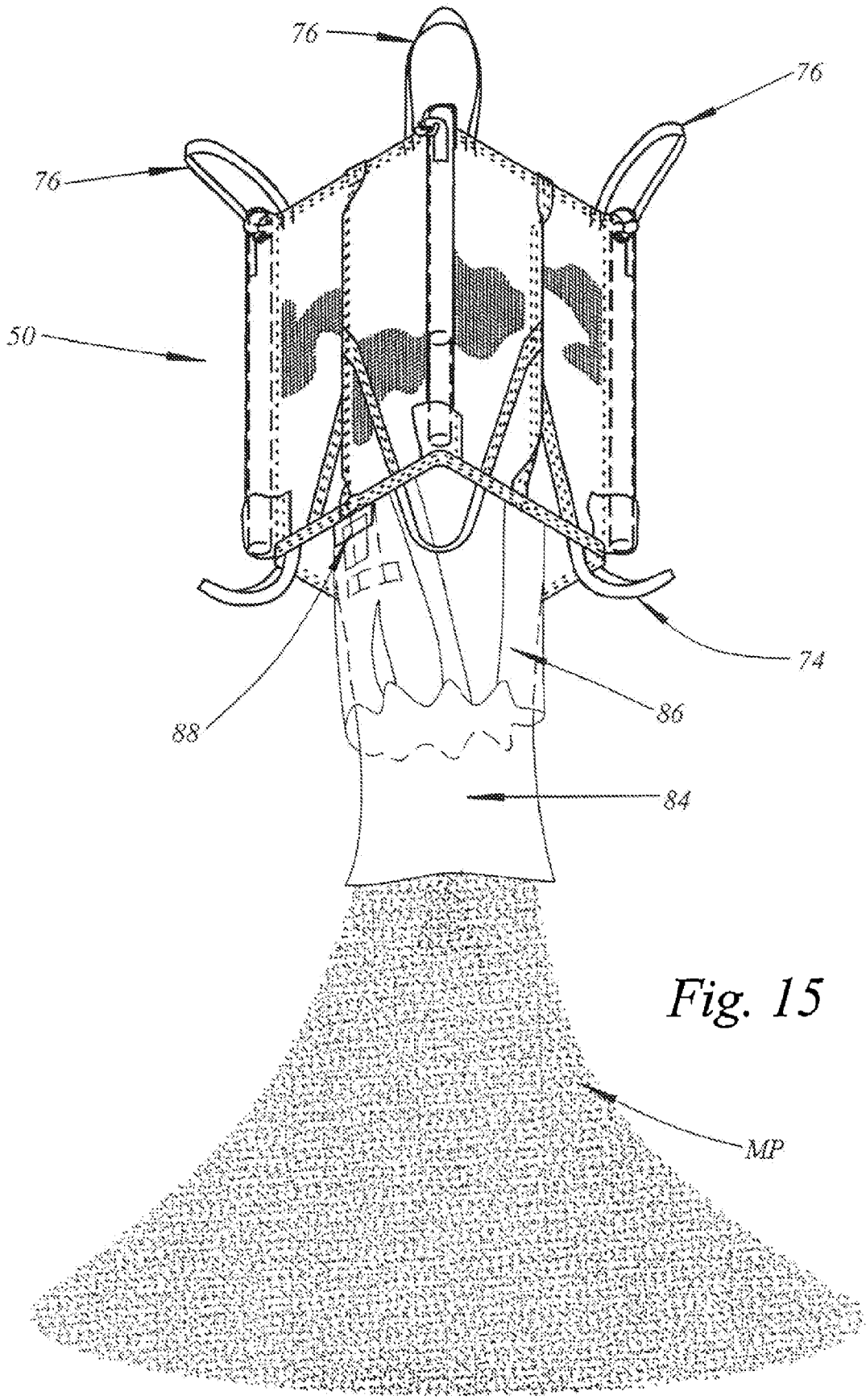
FIG. 15 is an illustration of the bulk bag of FIG. 12 showing the bulk bag at a still later stage in the discharge of product therefrom.
Figure 16:
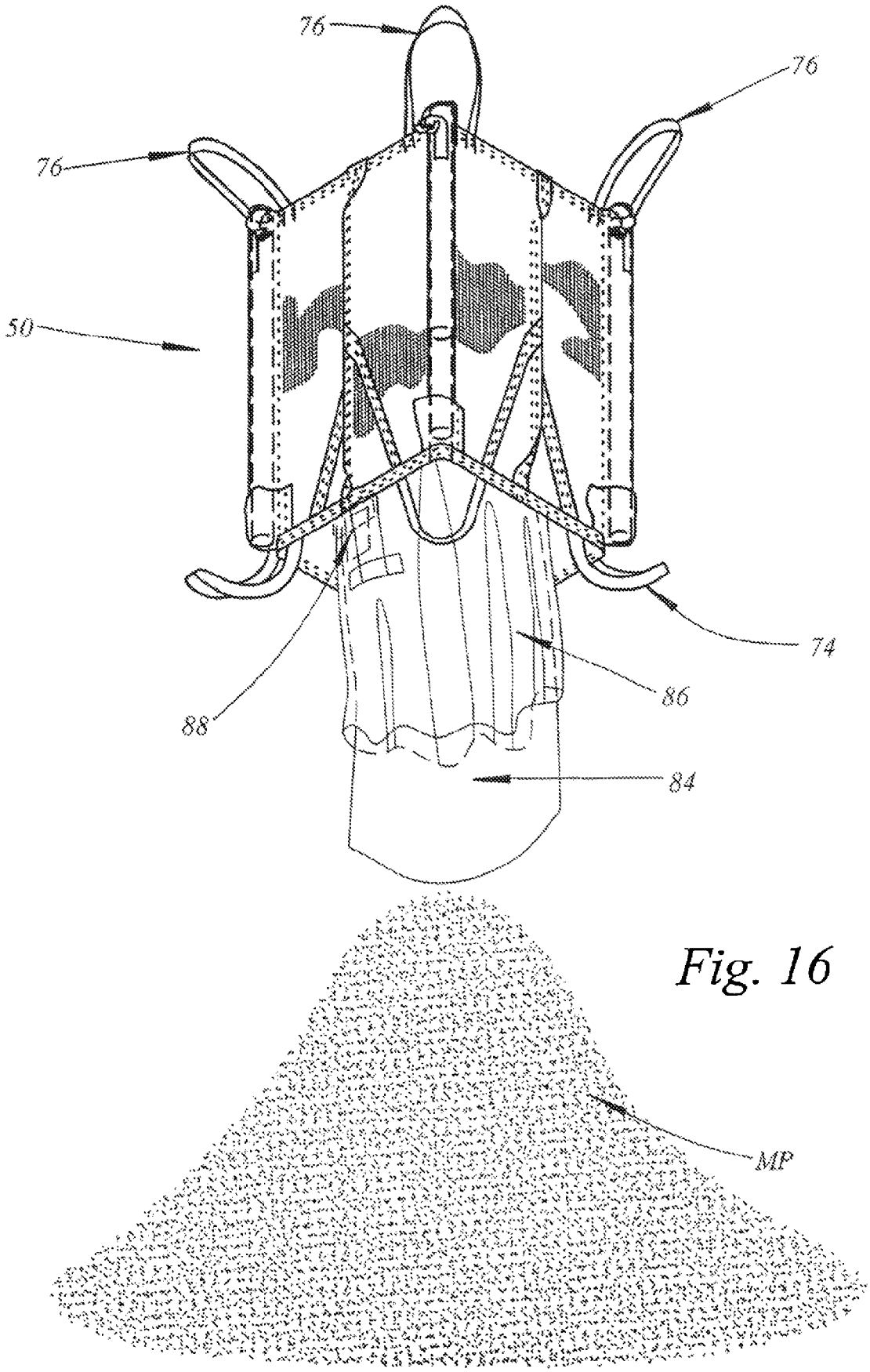
FIG. 16 is an illustration of the bulk bag of FIG. 12 showing the completion of the discharge of product therefrom.

FIG. 14 shows the bulk bag 50 completely inverted with the securing loops 76 still securing the bulk bag 50 to the tip over apparatus. As the meat product MP discharges from the interior of the liner 84 of the bulk bag 50, the liner 84 is pulled outwardly from the interior of the bulk bag and is turned inside out. FIG. 15 illustrates the bulk bag 50 with the discharge of the meat product MP therefrom substantially complete, and FIG. 16 illustrates the bulk bag 50 after the discharge of the meat product MP from the bulk bag has been completed. At this point the liner 84 is completely turned inside out with the skirt 86 now positioned on the outside of the liner proper.

Referring to FIGS. 17 through 20, inclusive, there is shown a bulk bag liner 100 useful in receiving, transporting, and discharging meat products comprising a third embodiment of the invention. The liner 100 comprises a length of tubular plastic film 102 which may be formed from conventional polymeric materials such as polyethylene. A first seam 104 closes one end of the liner 100 in the manner of a trash bag.

After the seam 104 is formed, the liner 100 is formed into a rectangular configuration whereupon seams 106 and 108 are formed at the same end of the liner 100 as the seam 104. In this manner the liner 100 is retained in a rectangular configuration having dimensions which approximate the interior dimensions of the bulk bag in which the liner 100 will be used.

The seams 104, 106, and 108 may comprise heat seals. Alternatively, the seams 104, 106, and 108 may be adhesively constructed. Other conventional techniques for seaming polymeric materials may also be utilized in the practice of the invention.

Figure 18:
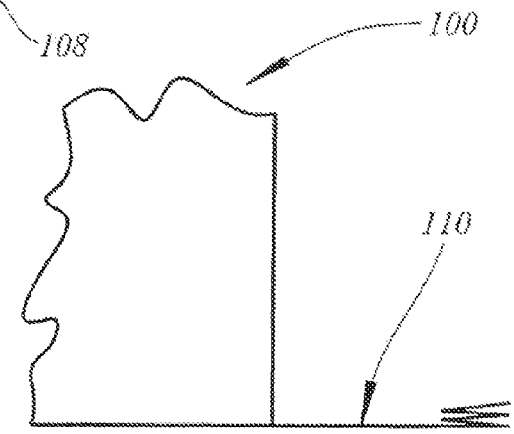
FIG. 18 is a partial side view of the liner of FIG. 17.

As indicated above, the foregoing steps change the cross-sectional configuration of the liner 100 from a circle to a rectangle having predetermined dimensions. The formation of the seams 104, 106, and 108 also results in triangular tabs 110 extending from the opposite sides of the liner 100. As shown in FIG. 18, the distal ends 112 of each tab 110 may be rolled or folded to provide additional tear resistance.

Figure 19:
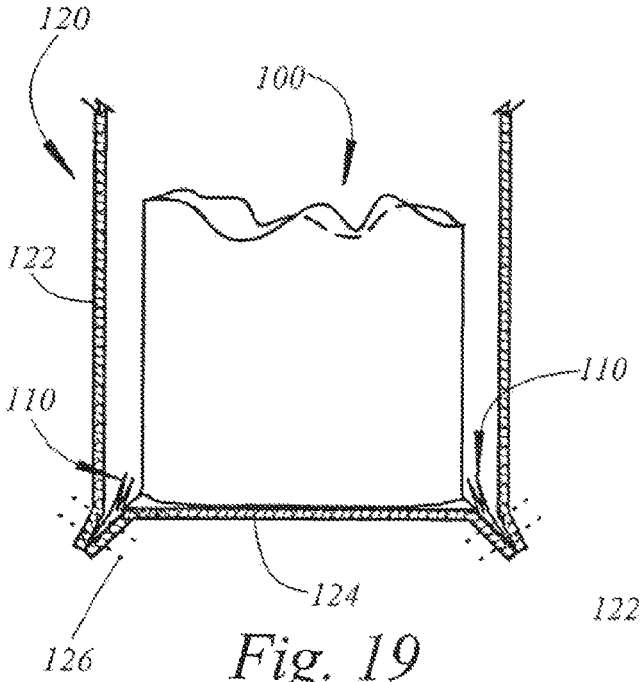
FIG. 19 is an illustration of the liner of FIG. 17 installed in a bulk bag.

Referring to FIG. 19, there is shown a bulk bag 120 comprising one or more side walls 122 and a bottom wall 124. The side wall(s) 122 are joined to the bottom wall 124 by seams 126.

Figure 17:
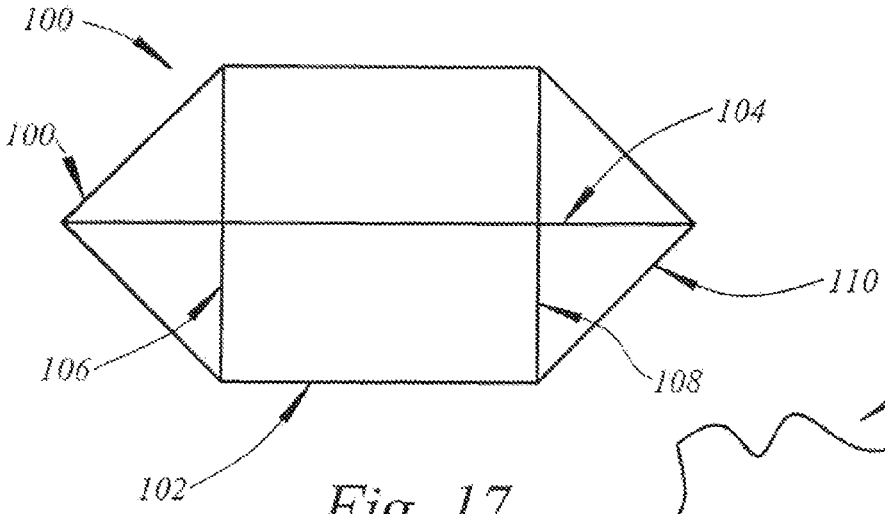
FIG. 17 is a top view of a bulk bag liner useful in conjunction with a third embodiment of the invention.

FIG. 19 also shows the liner 100 shown in FIGS. 17 and 18 described hereinabove in conjunction therewith positioned in the bulk bag 120. The tabs 110 extending from the opposite sides of the lower end of the liner 100 are positioned between the lower edges of the side wall(s) 122 and the lateral edges of the bottom wall 124. The seams 126 extend through the tabs 110 to secure the liner 100 within the bulk bag 120. As shown in FIG. 18 and described hereinabove in conjunction therewith, the distal ends of the tabs 110 may be rolled or folded to provide additional tear strength.

The bulk bag 120 having the liner 100 secured therein is used to receive, transport, and discharge meat products. As will be appreciated by those skilled in the art, meat products are received in the liner 100 with the bulk bag 120 oriented as shown in FIG. 19.

Figure 20:
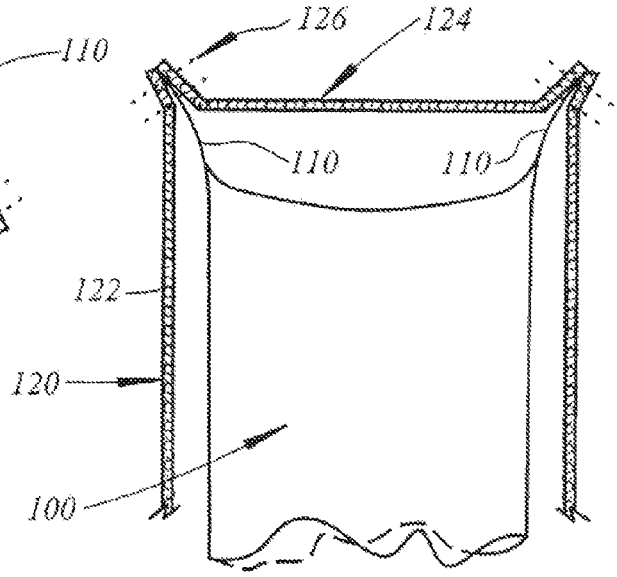
FIG. 20 is an illustration of the discharge of the bulk bag of FIG. 19.

The meat products received within the bulk bag 120 are discharged from the liner 100 thereof by inverting the bulk bag 120 as shown in FIG. 20. The sticky nature of the meat products causes the liner 100 to move downwardly (FIG. 20) relative to the bulk bag 120 as the meat products are discharged therefrom. The tabs 110 at the closed end of the liner 100 allow the liner 100 to move down a limited amount and then prevent further limited movement. The abrupt stoppage of the downward movement of the liner 100 which is caused by sewing the tabs 110 of the liner 100 into the seams joining the side wall(s) and the bottom wall of the bulk bag 120, causes the meat products to disengage from the liner 100 and fully discharge from the bulk bag 120.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. A bulk bag for receiving, storing, transporting, and discharging meat and meat products comprising:

four side walls formed from woven polypropylene fabric and having upper and lower edges;

the side walls defining an enclosure characterized by four corners;

a bottom wall formed from woven polypropylene fabric and secured to the lower edges of the side walls;

four pockets each located at one of the corners of the side walls and each having upper and lower ends coincident with the upper and lower edges of the adjacent side walls, respectively;

four support members each received in one of the pockets and each having a length substantially equal to the distance between the upper and lower ends of the pockets;

means located at the upper end of each pocket for preventing contaminants from entering the pocket;

means located at the lower end of each pocket for facilitating removal of the support member from the pocket following use of the bulk bag;

the side walls having reinforced edges extending upwardly from the bottom wall to the upper edges thereof;

side seams joining the side walls at the reinforced edges;

lift loops secured at the reinforced edges of the side walls and extending above the upper edges of the side walls to facilitate transportation of the bulk bag and the contents thereof at a minimum distance from a ground surface; and means located at the intersection of the side walls and the bottom wall for securing the bulk bag to a tip over apparatus.

2. The bulk bag for receiving, storing, transporting, and discharging meat and meat products according to claim 1 further comprising:

a liner positioned within the enclosure defined by the side walls and extending across the entirety of the bottom wall and upwardly from the lower edges to the upper edges of the side walls for receiving meat and meat products therein; and a plurality of tabs securing the liner to the upper edges of the side walls thereby permitting the liner to move outwardly from the rectangular enclosure defined by the side walls as the bulk bag is tipped over to facilitate full and complete discharge of meat and meat products from the bulk bag.

* * * * *